US011315377B2

(12) United States Patent
Enomoto

(10) Patent No.: US 11,315,377 B2
(45) Date of Patent: Apr. 26, 2022

(54) COIN SEPARATING AND FEEDING DEVICE IN A COIN PROCESSING DEVICE

(71) Applicant: Asahi Seiko Co., Ltd., Tokyo (JP)

(72) Inventor: Minoru Enomoto, Saitama (JP)

(73) Assignee: Asahi Seiko Co., Ltd.

( * ) Notice: Subject to any disclaimer, the term of this patent is extended or adjusted under 35 U.S.C. 154(b) by 83 days.

(21) Appl. No.: 16/706,423

(22) Filed: Dec. 6, 2019

(65) Prior Publication Data

US 2020/0242874 A1 Jul. 30, 2020

(30) Foreign Application Priority Data

Jan. 28, 2019 (JP) ..... JP2019-012605

(51) Int. Cl.
*G07D 3/12* (2006.01)

(52) U.S. Cl.
CPC ..... *G07D 3/128* (2013.01)

(58) Field of Classification Search
CPC ..... G07D 3/128
See application file for complete search history.

(56) References Cited

U.S. PATENT DOCUMENTS 5,022,889 A * 6/1991 Ristvedt ..... G07D 3/128 453/32
5,688,166 A 11/1997 Chen
7,377,846 B2 5/2008 Umeda
7,470,174 B2 12/2008 Umeda et al.
8,967,361 B2 * 3/2015 Martin ..... G07D 3/16 194/215
9,022,841 B2 * 5/2015 Martin ..... G07D 9/008 221/253

(Continued)

FOREIGN PATENT DOCUMENTS

EP 1617384 3/2007
EP 1679667 9/2008

(Continued)

OTHER PUBLICATIONS

Enomoto, Minoru; Applicant-Initiated Interview Summary for U.S. Appl. No. 16/706,435, filed Dec. 6, 2019, dated Feb. 17, 2022, 4 pgs.

(Continued)

*Primary Examiner* — Thien M Le
*Assistant Examiner* — Asifa Habib
(74) *Attorney, Agent, or Firm* — Taylor English Duma LLP

(57) ABSTRACT

A coin separating and feeding device includes a separating and rotating body, a moving body, and a cover body. The separating and rotating body defines a concave portion defined in an upper surface and extending from each of an upper surface side and a peripheral surface side; and a separating concave portion disposed at a part of the concave portion and formed in a semi-circular shape by the moving body. The moving body is mounted at a rotary disk of the device, is configured to pivot about a support shaft, is pivoted by a drive means positioned under the rotary disk via a coupling body penetrating through a through hole defined in the rotary disk, and is configured to be moved from the coin receiving position to a coin delivering position when delivering coins. The cover body is disposed at an upper surface side of the through hole.

18 Claims, 8 Drawing Sheets

(56) References Cited

U.S. PATENT DOCUMENTS

| | | | | |
|---|---|---|---|---|
| 9,105,140 | B2 * | 8/2015 | Enomoto | G07D 3/128 |
| 2006/0113161 | A1 * | 6/2006 | Umeda | G07D 9/008 194/302 |
| 2006/0223428 | A1 * | 10/2006 | Fujii | G07F 17/3202 453/57 |
| 2007/0062783 | A1 * | 3/2007 | Hill | G07D 3/14 194/302 |
| 2007/0087676 | A1 | 4/2007 | Enomoto et al. | |
| 2009/0029638 | A1 | 1/2009 | Enomoto | |
| 2010/0041325 | A1 | 2/2010 | Takeuchi | |
| 2012/0145741 | A1 | 6/2012 | Enomoto | |
| 2014/0170948 | A1 * | 6/2014 | Enomoto | G07D 3/06 453/3 |
| 2016/0171809 | A1 | 6/2016 | Ohtomo | |
| 2020/0219352 | A1 * | 7/2020 | Mennie | G07D 3/128 |
| 2020/0242873 | A1 | 7/2020 | Enomoto | |

FOREIGN PATENT DOCUMENTS

| | | |
|---|---|---|
| EP | 1777661 | 12/2009 |
| JP | 4665087 | 4/2011 |
| JP | 4784806 | 10/2011 |
| JP | 4997374 | 8/2012 |
| JP | 2014134972 | 7/2014 |
| JP | 5945773 | 7/2016 |

OTHER PUBLICATIONS

Enomoto, Minoru; Non-Final Office Action for U.S. Appl. No. 16/706,435, filed Dec. 6, 2019, dated Dec. 7, 2021, 28 pgs.

* cited by examiner

COIN SEPARATING AND FEEDING DEVICE IN A COIN PROCESSING DEVICE

BACKGROUND OF THE INVENTION

Field of the Invention

The present invention relates to a coin separating and feeding device in a coin processing device in which coins of a plurality of denominations and having different diameters are separated one by one and fed to the next process.

Particularly, the present invention relates to a coin separating and feeding device in a coin processing device capable of essentially preventing malfunctions, etc. caused by minute contamination which enters together with coins and falls onto a drive mechanism of the coin separating and feeding device.

Note that the term "coin" used in the present description is a concept including coins or tokens, etc. having a certain thickness and diameter in a disc-shape, as well as coins in a deformed octagonal shape such as British twenty or fifty pence coins.

Description of the Background Art

As the first related art, a coin feeding device has been known, in which coins are held in a partition concave portion disposed on an upper surface of a rotary disc and partitioned one by one, thereafter, delivered to a coin transport device, wherein the partition concave portion of the rotary disc is in a semi-circular shape opened to the upper surface side of the rotary disk as well as open to the peripheral surface side of the rotary disk, has, at a part, a coin advancing portion to form a part of the partition concave portion and is provided with a moving body which is movable in the direction of the diameter of the rotary disk, wherein the moving body is positioned at the side of the coin advancing portion at the time of receiving the coins and is moved to the peripheral surface open side at the time of delivery of the coins to the coin transport device, is in an arc shape and is mounted at the rotary disk such that pivot movement is possible about one end as a fulcrum, wherein a driven body, which is mounted at the moving body, is mounted at the lower end of a pin penetrating through a through hole formed at the rotary disk and is inserted in a groove cam which is positioned under the rotary disk (Japanese Patent No. 4784806, FIGS. 3 to 5, paragraphs [0006] to [0012]).

As the second related art, a coin hopper has been known, including a retaining chamber that retains coins in a randomly stacked state and is formed with a bottom hole;

a partition plate that is disposed at the bottom hole of the retaining chamber and has a plurality of disk-shaped penetration holes for dropping the coins retained in the retaining chamber from the upper side to the lower side and partitions the coins one by one;

a coin holding plate that has a diameter approximately the same as that of the partition plate and is approximately concentric with the partition plate, is disposed under and parallel to the partition plate with a predetermined distance, holds the coins falling through the penetration hole of the partition plate, forms a coin holding space between the coin holding plate and the partition plate and is rotated integrally with the partition plate;

a coin pushing body that is disposed under the partition plate, pushes the coins held in the predetermined position by the coin holding plate in the direction of the outer periphery of the partition plate;

an outer peripheral direction passage that is formed by a front guide body which continues from the coin holding space, extends toward the outer periphery of the partition plate and is positioned in a leading position of the normal rotational direction of the partition plate on the back side of the partition plate, and a rear guide body which is positioned in a trailing position;

wherein the coin pushing body is provided to be movable at a predetermined timing between the push-out position which is positioned in the coin holding space right under the penetration hole on the back side of the partition plate and the waiting position which is on the side of the rotational axis of the partition plate as well as on the side of the penetration hole and hides under the partition plate at the time of normal rotation of the partition plate by a groove cam in which a cam follower which is mounted at the lower end of a follower support shaft penetrating through the through hole formed at the coin holding plate is inserted, and wherein the coin pushing body gradually moves from the waiting position toward the push-out position, moves the coins from the through hole in the outer peripheral direction of the partition plate through the outer direction passage upon arrival at the push-out position in a position corresponding to the predetermined position, and thereafter, is gradually moved to the waiting position (Japanese Patent No. 5945773, FIGS. 1 to 17, paragraph [0013]).

As the third related art, a coin image capturing device has been known, in which coins are received one by one in a coin retaining portion formed between a plurality of pushing bodies extending in the peripheral direction of a rotating body which is rotated, images of the coins are captured by an image capturing device which is disposed facing a movement path of the coins moving on a base, and image capturing information on the coins is acquired, wherein the pushing body is formed in a V-shape which has a peak in the center in length in the peripheral direction of the image capturing device and thereby has a pair of pushing portions provided over the peak, a press body is provided in a position facing the peak, the press body pressing the coins to the pushing portions at least while the coins which are pushed by the pair of pushing portions face the image capturing device, and the press body is moved by a cam between a press position in which the coins are elastically pressed to the pair of pushing portions and a receiving position in which the coins are received (Japanese Patent No. 6074640, FIGS. 1 to 17, paragraphs [0018] and [0032]).

The first related art has such a structure that the moving body for pushing out the coins to the peripheral edge side of the rotary disk is driven by the groove cam via a driven body which is mounted at the lower end of a pin penetrating through the through hole formed at the rotary disk. By this structure, minute contamination enters together with the coins, falls onto the groove cam via the through hole and is deposited. If the amount of deposited contamination increases by long-term use, there is a concern of negative influence that would disturb the smooth movement of the driven body.

The second related art has such a structure that the coin pushing body is moved by the cam follower which is mounted at the follower support shaft penetrating through the through hole formed at the coin holding plate and is inserted in the groove cam. Also, in this case, similar to the first related art, if minute contamination enters together with the coins, falls onto the groove cam via the through hole and is deposited and the amount of deposited contamination increases by long-term use, there is a concern of negative influence that would disturb the smooth movement of the driven body.

The third related art is configured such that the press body which stabilizes the position of the coins on the rotating base is driven by a cam disposed above. Thus, since a component that drives the press body does not penetrate through the base in the lower position, minute contamination does not fall under the base. However, it is inconvenient that it is difficult to check the status of processing coins because the cam that drives the press body is disposed above the press body.

The object of the present invention is to provide a coin separating and feeding device in a coin processing device capable of reducing disadvantages caused by minute contamination which enters together with the coins and falls downward.

SUMMARY OF THE INVENTION

In order to achieve the above object, the first aspect according to claim 1 has the following feature.

A coin separating and feeding device in a coin processing device, the coin separating and feeding device comprising:

a separating and rotating body defining a concave portion defined in an upper surface of the separating and rotating body and extending from each of an upper surface side and a peripheral surface side of the separating and rotating body; and a separating concave portion disposed at a part of the concave portion and formed in a semi-circular shape by a moving body positioned in a coin receiving position;

the moving body, the moving body mounted at a rotary disk of the coin separating and feeding device, the moving body configured to pivot about a support shaft configured as a fulcrum, the moving body pivoted by a drive means positioned under the rotary disk via a coupling body penetrating through a through hole defined in the rotary disk, and the moving body configured to be moved from the coin receiving position to a coin delivering position when delivering coins; and a cover body disposed at an upper surface side of the through hole.

The second aspect of the present invention according to claim 2 has the following feature.

A coin separating and feeding device in a coin processing device, the coin separating and feeding device comprising:

a separating and rotating body defining a concave portion that defined in an upper surface of the separating and rotating body and extending from each of an upper surface side and a peripheral surface side of the separating and rotating body, and a separating concave portion disposed at a part of the concave portion and formed in a semi-circular shape by a moving body positioned in a coin receiving position;

the moving body, the moving body mounted at a rotary disk of the coin separating and feeding device, the moving body configured to pivot about a support shaft configured as a fulcrum, the moving body pivoted by a drive means positioned under the rotary disk via a coupling body penetrating through a through hole defined in the rotary disk, and the moving body configured to be moved from the coin receiving position to a coin delivering position when delivering coins; and a cover body disposed at an upper surface side of the through hole, defining a disk shape defining a predetermined radius centered on the support shaft, and integrated with the moving body.

The third aspect of the present invention according to claim 3 has the following feature.

A coin separating and feeding device in a coin processing device, the coin separating and feeding device comprising:

a separating and rotating body defining a concave portion defined in an upper surface of the separating and rotating body and extending from each of an upper surface side and a peripheral surface side of the separating and rotating body; and a separating concave portion disposed at a part of the concave portion and formed in a semi-circular shape by a moving body positioned in a coin receiving position;

the moving body, the moving body mounted at a rotary disk of the coin separating and feeding device, the moving body configured to pivot about a support shaft configured as a fulcrum, the moving body coupled to a driven body positioned in a groove cam positioned under the rotary disk in an eccentric position of the moving body via a coupling body penetrating through a through hole defined in the rotary disk and formed in an arc shape centered on the support shaft, and the moving body configured to be moved from the coin receiving position to a coin delivering position by the groove cam via the driven body and the coupling body when delivering the coins; and a cover body disposed at an upper surface side of the through hole, defining a disk shape defining a predetermined radius centered on the support shaft, and integrated with the moving body.

According to the first aspect, similar to conventional art, the moving body is moved to the coin receiving position and the coin delivering position at a predetermined timing by the drive means which is disposed under the rotary disk by the coupling body penetrating through the through hole formed at the rotary disk. The through hole needs a width necessary for the movement of the coupling body, but the most part is covered with a cover body which is disposed on the upper surface side. It is sufficient if a gap necessary for the cover body on the upper surface side of the through hole is present in which the cover body can be rotated relative to the rotary disk even considering manufacturing tolerances, etc. Accordingly, the gap for the cover body can be made much smaller than the width of the through hole and is essentially covered. Also, if the cover body is enlarged up to the position in which the cover body does not overlap the through hole, the through hole is completely covered. Thus, since the through hole is essentially covered, minute contamination which enters together with the coins and falls downwards can be greatly reduced. Thereby, a coin separating and feeding device in a coin processing device which can reduce disadvantages caused by minute contamination can be provided, so that the object of the present invention can be achieved, which is advantageous.

According to the second aspect, similar to conventional art, the moving body is moved to the coin receiving position and the coin delivering position at a predetermined timing by the drive means disposed under the rotary disk by the coupling body which penetrates through the through hole formed at the rotary disk. The through hole needs a width necessary for the movement of the coupling body while the most or entire part of the through hole can be covered with the disk-shaped cover body disposed on the upper surface side. Since the disk-shaped cover body is formed in a circular shape with a predetermined radius centered on a fulcrum of the pivot movement of the moving body, the cover body is always in the same peripheral edge position even if rotating integrally with the moving body. Accordingly, even if the moving body is rotated, it is sufficient if the gap necessary for the rotation of the cover body on the upper surface side of the through hole with respect to the cover body is present as a gap in which the cover body is rotatable relative to the rotary disk even considering manufacturing tolerances, etc. Accordingly, the gap for the cover body can be made much smaller than the width of the through hole and can be disposed in a non-overlapping position. Thus, minute contamination that enters together with the coins and falls downward can be greatly reduced. Accordingly, the coin separating and feeding device in a coin processing device capable of reducing disadvantages caused by minute contamination can be provided, so that the object of the present invention can be achieved, which is advantageous.

According to the third aspect, similar to conventional art, the moving body is moved to the coin receiving position and the coin delivering position at a predetermined timing by the groove cam disposed under the rotary disk by the coupling body which penetrates through the through hole formed at the rotary disk. The through hole needs a width necessary for the movement of the coupling body while the most part of the through hole can be covered with the disk-shaped cover body disposed on the upper surface side or the cover body can be disposed such that it does not fully overlap the through hole. Since the disk-shaped cover body is formed in a circular shape with a predetermined radius centered on a fulcrum of the pivot movement of the moving body, the cover body is always in the same peripheral edge position even if rotating integrally with the moving body. Accordingly, even if the moving body is rotated, it is sufficient if the gap necessary for rotation of the cover body on the upper surface side of the through hole with respect to the cover body is present as a gap in which the cover body is rotatable relative to the rotary disk even considering manufacturing tolerances, etc. Accordingly, the gap for the cover body can be made much smaller than the width of the through hole and the cover body can be configured such that it does not overlap the through hole. Thus, minute contamination that enters together with the coins and falls downward can be reduced. Thereby, the coin separating and feeding device in a coin processing device capable of reducing disadvantages caused by minute contamination can be provided, so that the object of the present invention can be achieved, which is advantageous.

DESCRIPTION OF THE PREFERRED EMBODIMENTS

Figure 1:
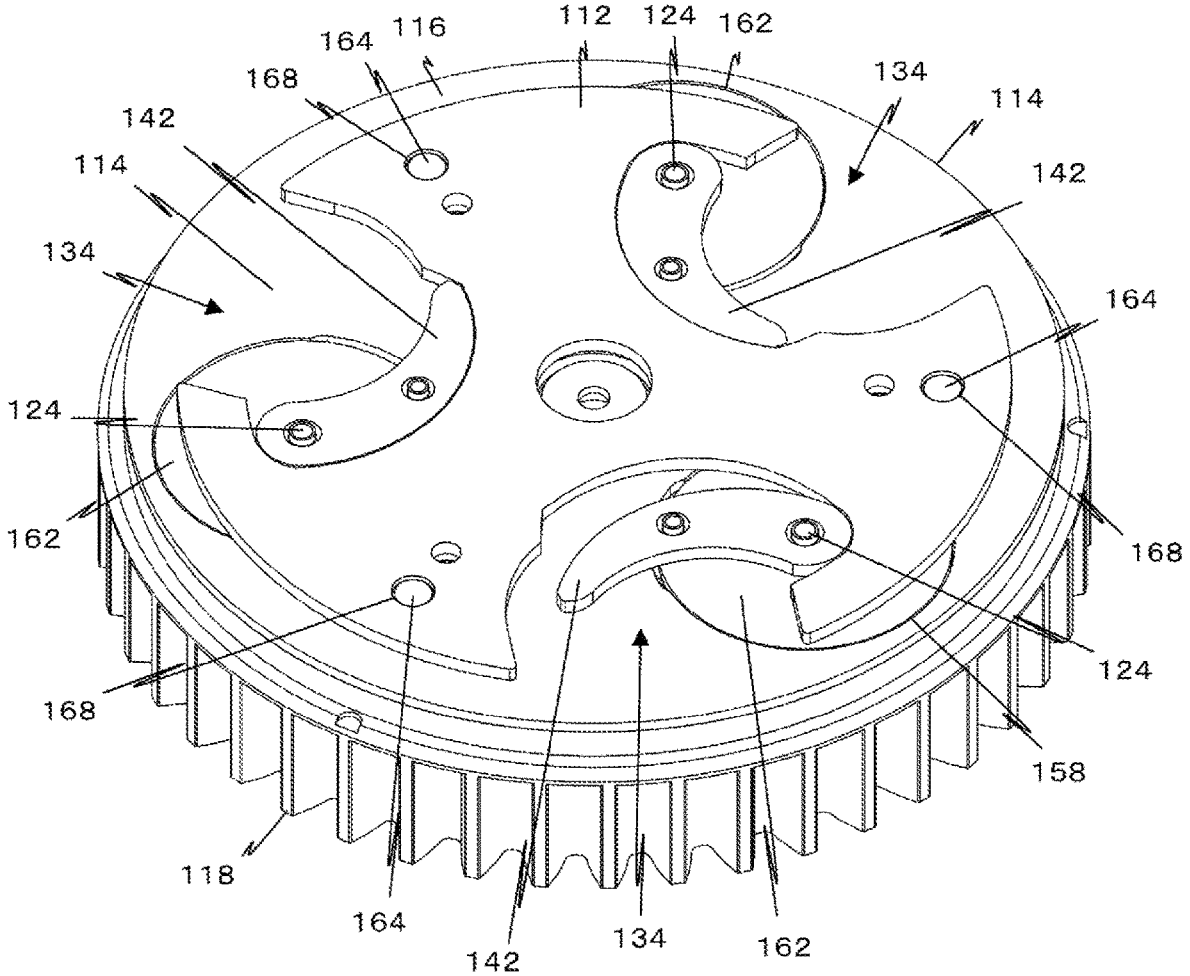
FIG. 1 is a perspective view of a coin separating and feeding device in a coin processing device according to the first embodiment of the present invention.

The preferred embodiment of the present invention is:

A coin separating and feeding device in a coin processing device including a separating and rotating body having a concave portion that is formed on an upper surface of a rotary disk and configured by opening the upper surface side and the peripheral surface side of the rotary disk, and a separating concave portion that is disposed at a part of the concave portion and is formed in a semi-circular shape by a moving body which is positioned in a coin receiving position, the moving body being mounted at the rotary disk such that pivot movement is possible about one end as a fulcrum, being pivoted by a drive means which is positioned under the rotary disk via a coupling body which penetrates through a through hole provided at the rotary disk and being configured to be moved from the coin receiving position to a coin delivering position on the peripheral surface open side at the time of delivering the coins to the next process, wherein a cover body is disposed on the upper surface side of the through hole.

According to the present invention, it is preferable that the separating and rotating body is configured by a rotary disk which is configured by a slide plate made of a stainless steel plate fixed on an upper surface of a rotating disk body of resin and bored with a circular cover body accommodation hole to accommodate a circular cover body and a separating plate which has a concave portion formed in an approximately fan shape, the cover body is formed by a predetermined radius centered on the fulcrum of rotation of the moving body and formed to a disk which is passed into the cover body accommodation hole rotatably. This is because it improves the ability for manufacturing and durability.

Also, according to the present invention, it is preferable that the upper end of the coupling body penetrating the peripheral edge portion of the cover body and extending to the side under the rotating disk body is fixed to the moving body and a cam follower is rotatably mounted to the lower end of the coupling body.

Furthermore, according to the present invention, it is preferable that the drive means is a groove cam which is formed about the rotational axis of the rotating disk body and is in an egg shape.

FIRST EMBODIMENT

The coin separating and feeding device 100 in the coin processing device according to the first embodiment will now be described with reference to FIGS. 1 to 7. The coin separating and feeding device 100 has a function to separate coins C of a plurality of denominations and having different diameters one by one that have been randomly retained and feed the coins C to the next process, for example, the coin identification device. The coin separating and feeding device 100 according to the first embodiment is a coin separating and feeding device that can be replaced, for example, with a pushing disk in the above-mentioned JP 4784806, in a coin processing device. Accordingly, the separating and rotating body 102 configuring the coin separating and feeding device 100 is rotated at a predetermined speed about the rotational axis RSL which is diagonally set, and a retaining container (not shown) for retaining the coins C is disposed in front of the upper surface of the separating and rotating body 102.

The coin separating and feeding device 100 according to the first embodiment includes the separating and rotating body 102 for individually separating the coins C with different diameters, a moving body unit 104 that moves the coins that have been separated into the peripheral edge direction of the separating and rotating body 102 and a drive means 106 for moving the moving body unit 104. The cover body 162 is installed in the moving body unit 104.

Figure 3:
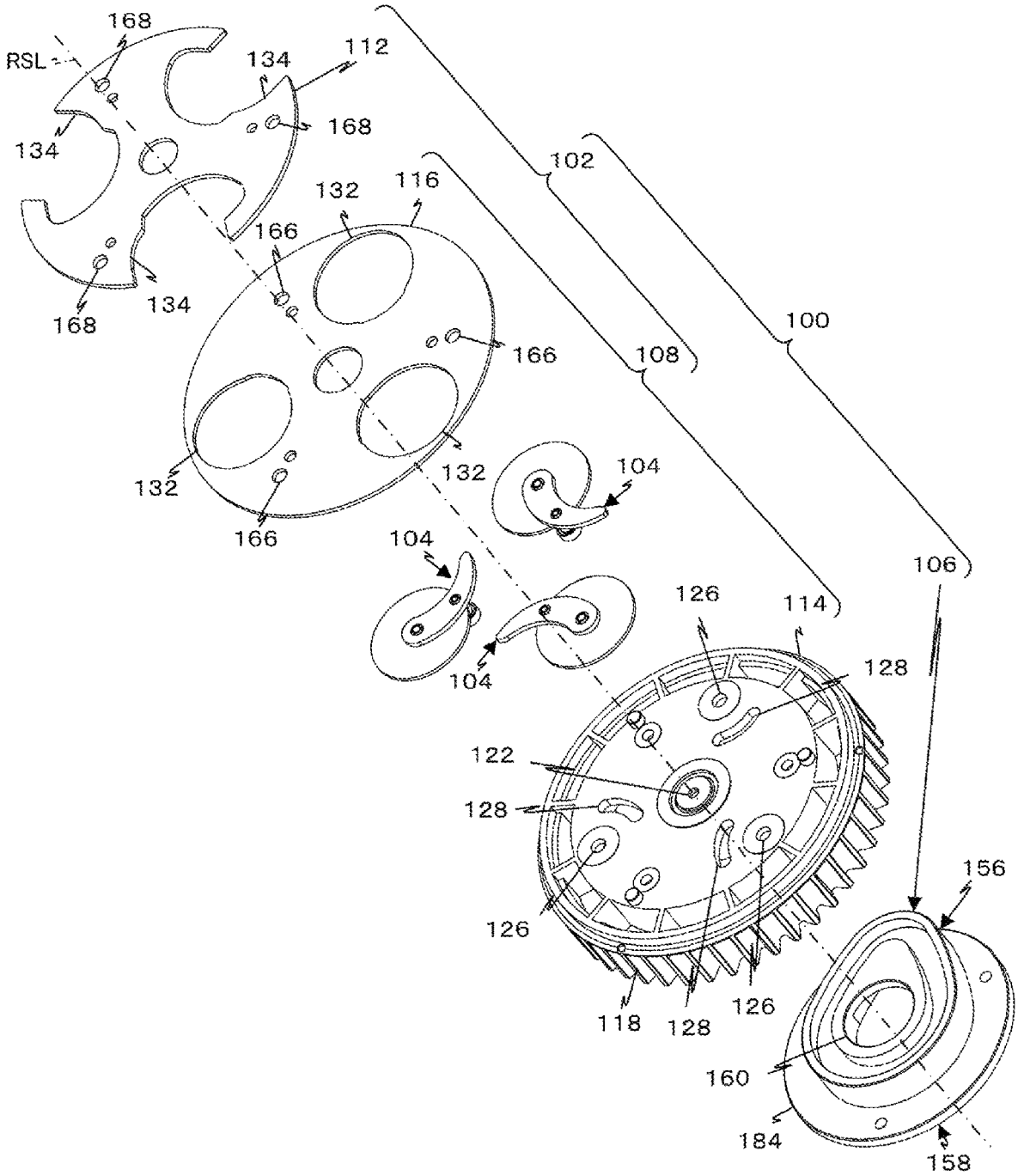
FIG. 3 is an exploded perspective view of the coin separating and feeding device of FIG. 1.
Figure 4A:
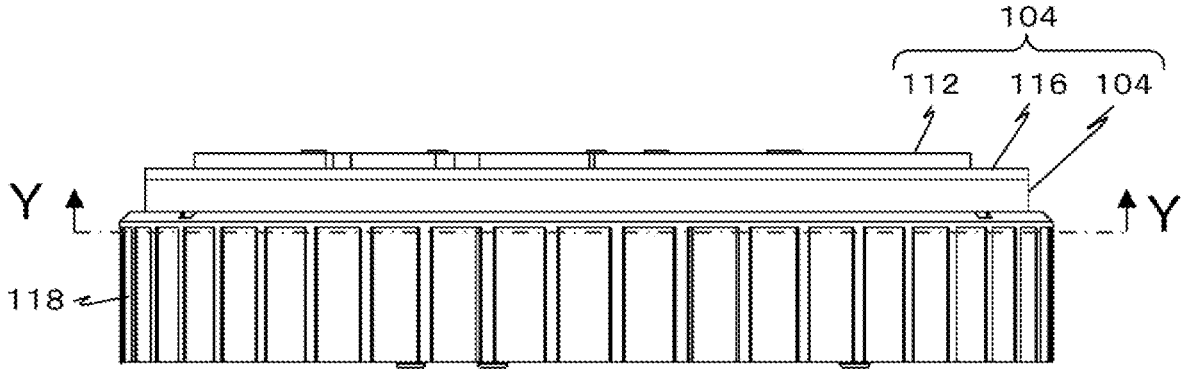
FIG. 4A is a front view of the coin separating and feeding device of FIG. 1.
Figure 4B:
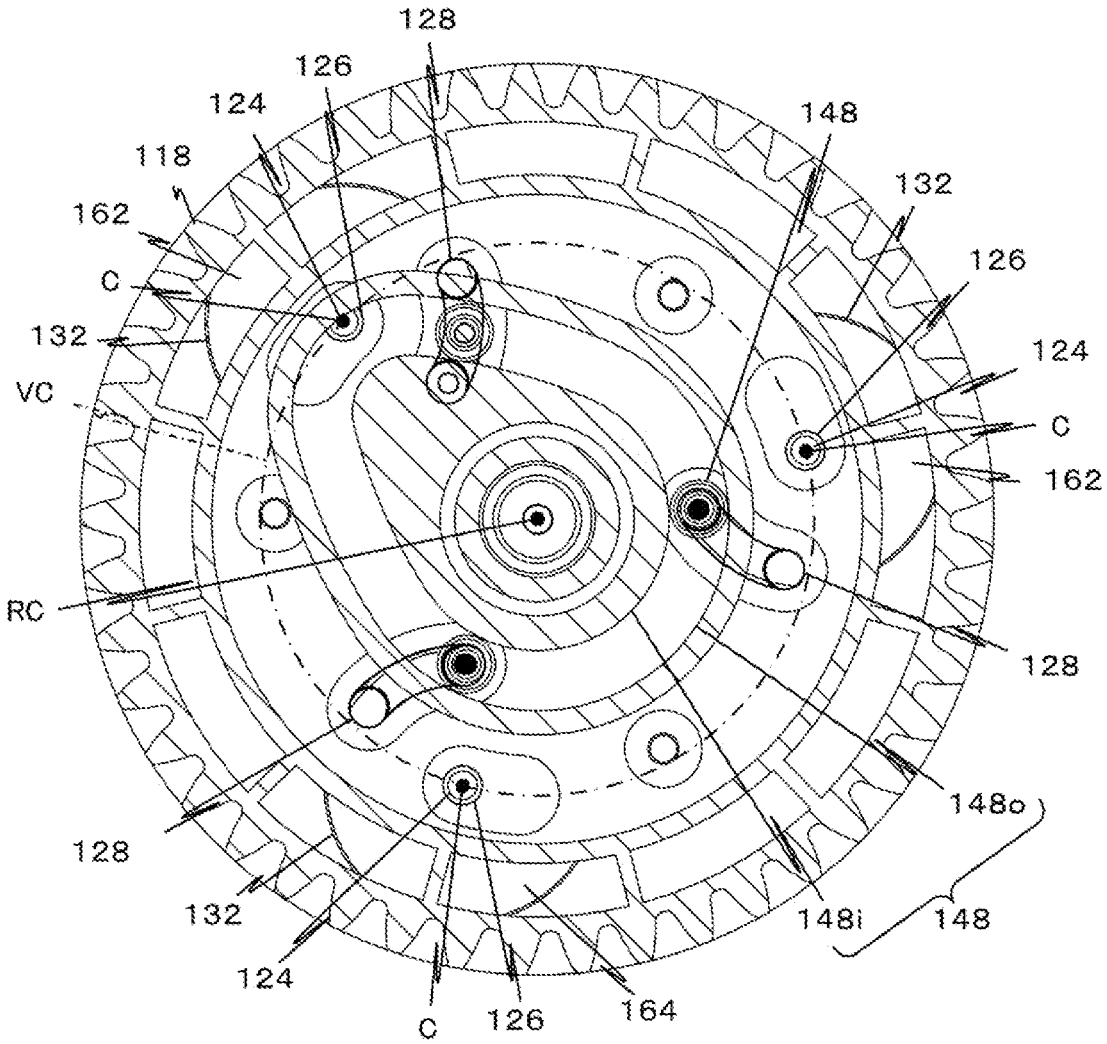
FIG. 4B is a sectional view of the coin separating and feeding device of FIG. 1 taken along the line Y-Y in FIG. 4A.
Figure 5:
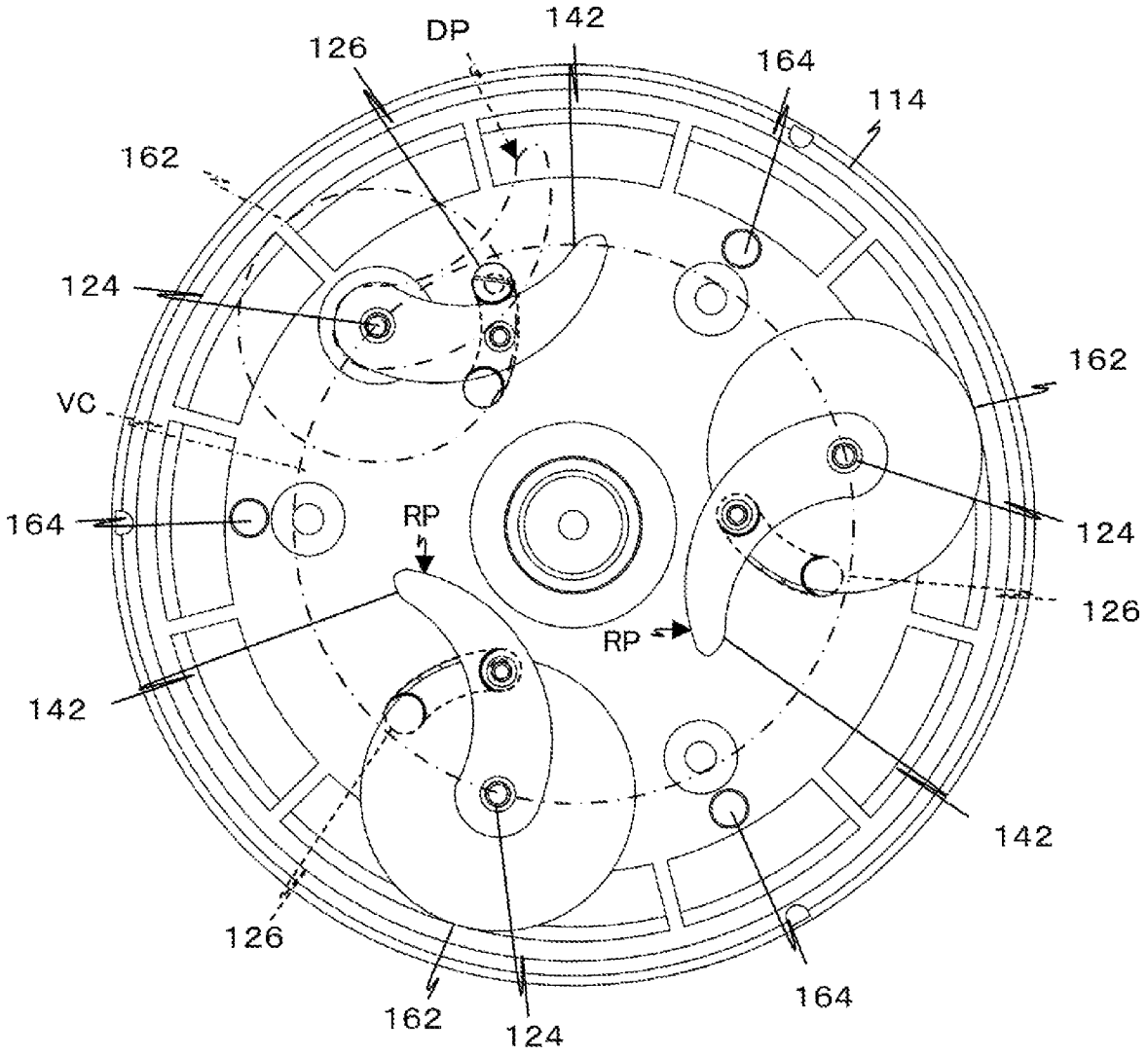
FIG. 5 is a plan view of the coin separating and feeding device of FIG. 1 in a state in which the slide base is removed and a part of the cover body is removed.

First, the separating and rotating body 102 will be described mainly with reference to FIG. 3

As stated above, the separating and rotating body 102 has a function to individually separate the coins C with different diameters. As illustrated in FIG. 3, the separating and rotating body 102 according to the present first embodiment is configured by a rotary disk 108 rotated about the rotational axis RSL which is inclined upward at a predetermined angle and a separating plate 112.

Next, the rotary disk 108 will be described.

The rotary disk 108 has a function to, during rotation, transport the coins C which have been individually separated by the separating plate 112 in the rotational direction. The rotary disk 108 according to the present first embodiment is configured in a disk-shape entirely having a predetermined thickness by a rotating disk body 114 and a slide plate 116. However, the rotating disk body 114 and the slide plate 116 can be configured in one piece.

Next, the rotating disk body 114 will be described.

The rotating disk body 114 has a base plate-like function by which other components configuring the coin separating and feeding device 100 are mounted. The rotating disk body 114 according to the first embodiment is configured in a shape of a disk body having a relatively large thickness in appearance and is formed with a driven gear 118 at the peripheral surface and with a circular rotating shaft bore 122 around the rotational axis RSL in which the rotational shaft (not shown) is fixed. However, in a sectional view in FIG. 2B, the rotating disk body 114 is formed in a cylinder shape with a cylindrical accommodation portion 120. A groove cam 156 serving as a later-mentioned drive means 106 is disposed in the accommodation portion 120. Materials of the rotating disk body 114 are not limited if the materials have a predetermined strength and processability. However, it is preferable that the rotating disk body 114 is made of resin having an excellent mechanical strength by molding. The rotating disk body 114 is formed with a support shaft through hole 126 along an axis parallel to the rotational axis RSL for penetration of the support shaft 124 of the moving body unit 104. According to the present first embodiment, three sets of moving body units 104 are disposed equidistantly. However, all of these have the same configuration and will be explained with the same reference numerals. Also, the configuration relating to the moving body unit 104 is provided at each moving body unit 104. However, all of these have also the same configuration and will be explained with the same reference numerals.

An arc-shaped through hole 128 with a predetermined radius, concentric with the support shaft through hole 126 (support shaft 124) with a center C which is positioned on a virtual circle VC with a predetermined radius centered on the rotational axis RSL, is formed respectively. The rotating disk body 114 is rotated at a predetermined speed by an electric motor (not shown) via a driven gear 118. A slide plate 116 is fixed on the upper surface of the rotating disk body 114. Note that it is sufficient if one or more moving body units 104 are present. However, three moving body units 104 are preferable because, in case of one moving body unit 104, the speed of separating the coins C is limited and, in case of more than three moving body units 104, the device becomes larger.

Next, the slide plate 116 will be described.

The slide plate 116 has such a function that the coins C that have been separated one by one are held on the upper surface and the coins C glide, in other words, slide, with the surface or backside being in surface contact, at a predetermined timing into the peripheral edge direction of the slide plate 116. According to the present first embodiment, the slide plate 116 is configured by a disk having the same diameter as the rotating disk body 114 and is fixed on the upper surface of the rotating disk body 114 in a concentric circular state. Furthermore, the slide plate 116 is configured by a thin plate made of stainless steel considering resistance against wear caused by friction between the slide plate 116 and the coins C of metal. Furthermore, a circular cover body accommodation hole 132 which is formed with a predetermined radius centered on the center C of the support shaft through hole 126 is formed corresponding to each of the above-mentioned support shaft through holes 126. A separating plate 112 is fixed on the upper surface of the slide plate 116. It is also possible to configure the rotating disk body 114 and the slide plate 116 in one piece.

Next, the separating plate 112 will be described mainly with reference to FIGS. 2A and 2B.

The separating plate 112 has a function to separate the coins C individually which have been retained randomly and have different diameters and hold the coins C. According to the first embodiment, the separating plate 112 is formed in a disk-shape having a radius which is a little smaller than that of the slide plate 116, is formed with a concave portion 134 for receiving the coins C one by one and retaining the coins C and is made of a metal plate of stainless steel, etc. considering durability and production costs. The dimensional relationship is set such that the thickness of the separating plate 112 is a little larger than the maximum thickness of the coins C amongst the coins C that will be used. This is because the movement to the next process while two or more coins C overlap in the concave portion 134 is to be prevented.

The concave portion 134 has a peripheral edge port 136 which is formed radially from the center of the separating plate 112 and is configured such that the peripheral edge side of the separating plate 112 is opened with a dimension which is slightly larger than the diameter of the coins having the maximum diameter. Note that the separating plate 112 can be integrally molded with the rotating disk body 114.

Figure 6A:
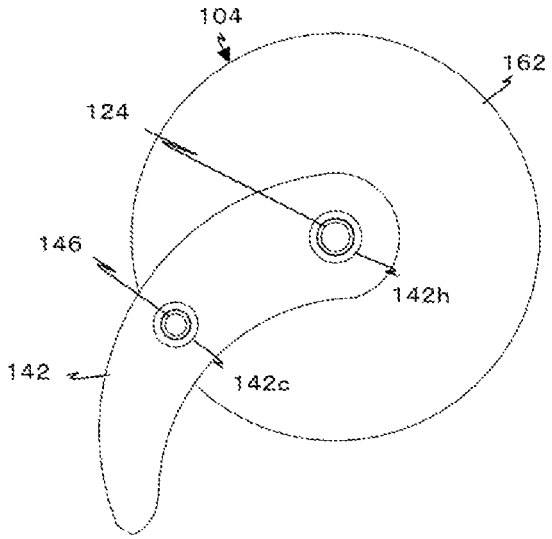
FIG. 6A is a plan view of the moving body unit of the coin separating and feeding device of FIG. 1.
Figure 6B:
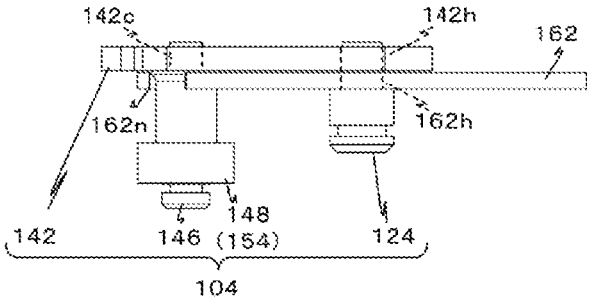
FIG. 6B is a front view of the moving body unit of FIG. 6A.
Figure 6C:
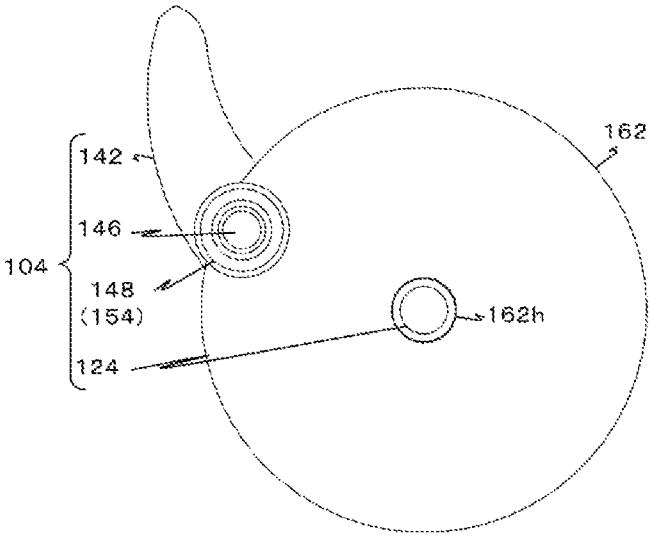
FIG. 6C is a backside view of the moving body unit of FIG. 6A.

Next, the moving body unit 104 will be described mainly with reference to FIGS. 6A-6C.

The moving body unit 104 has a function to move the moving body 142 between the coin receiving position RP and the coin delivering position DP at a predetermined timing and move the one separated coin C in the direction of the peripheral edge of the separating and rotating body 102. According to the present first embodiment, the moving body unit 104 includes a moving body 142, a support shaft 124, a coupling body 146 and a driven body 148.

First, the moving body 142 will be explained.

The moving body 142 is moved forward and backward between the coin receiving position RP and the coin delivering position DP (FIG. 5) and has a function to form a separating concave portion 152 in collaboration with the concave portion 134 in case of being positioned in the coin receiving position RP. The moving body 142 according to the present first embodiment is formed in an arc-shape and one end is fixed at the support shaft 124. The support shaft 124 is rotatably inserted into the support shaft through hole 126. In case of being positioned in the coin receiving position RP which is a bottom of the concave portion 134 on the side of the rotational axis RSL, the moving body 142 configures a separating concave portion 152 which is in a semi-circular shape in a plan view in collaboration with its inner peripheral edge 142*i* and the inner peripheral edge of the concave portion 134. Thereby, the separating concave portion 152 is a concave portion which is opened at the upper surface side and the peripheral edge side and is in a semi-circular shape in a plan view on the upper surface of the rotary disk 108 and is configured by a separating concave portion bottom surface 152*b* and a semi-circular separating concave portion side surface 152*s*. The separating concave portion 152 is set such that two coins C supposed to be handled having the minimum diameter are not accommodated in parallel. In other words, the separating concave portion 152 is configured with a size by which only one coin C is accommodated in such a state that the surface or the backside of the coin C is in surface contact with the slide plate 116.

Next, the support shaft 124 will be described.

As mentioned above, the support shaft 124 has a function to support the moving body 142 such that the pivot movement is possible. According to the present first embodiment, the support shaft 124 is a cylindrical shaft body which is rotatably inserted into the support shaft through hole 126 and is rotatably mounted at the rotating disk body 114.

Next, the coupling body 146 will be described.

The coupling body 146 couples the driven body 148 to the moving body 142. In other words, the coupling body 146 has a function to mount the cam follower 154 at the moving body 142. According to the present first embodiment, the middle portion of the coupling body 146 penetrates through the arc-shaped through hole 128, the upper end is fixed at the middle of the moving body 142 by caulking and the lower end is configured with the driven body 148. Thereby, the moving body 142 is moved via the coupling body 146 based on the position of the driven body 148.

Next, the driven body 148 will be explained.

The driven body 148 is positionally controlled by the drive means 106 and has a function to move the position of the moving body 142 to a predetermined position at a predetermined timing via the coupling body 146. According to the present first embodiment, the driven body 148 is the cam follower 154 and is rotatably mounted at the lower end of the coupling body 146. According to the present first embodiment, the cam follower 154 is a roller which is rotatable relative to the coupling body 146 and has a small radius. However, the cam follower 154 may not always be rotated.

Figure 7:
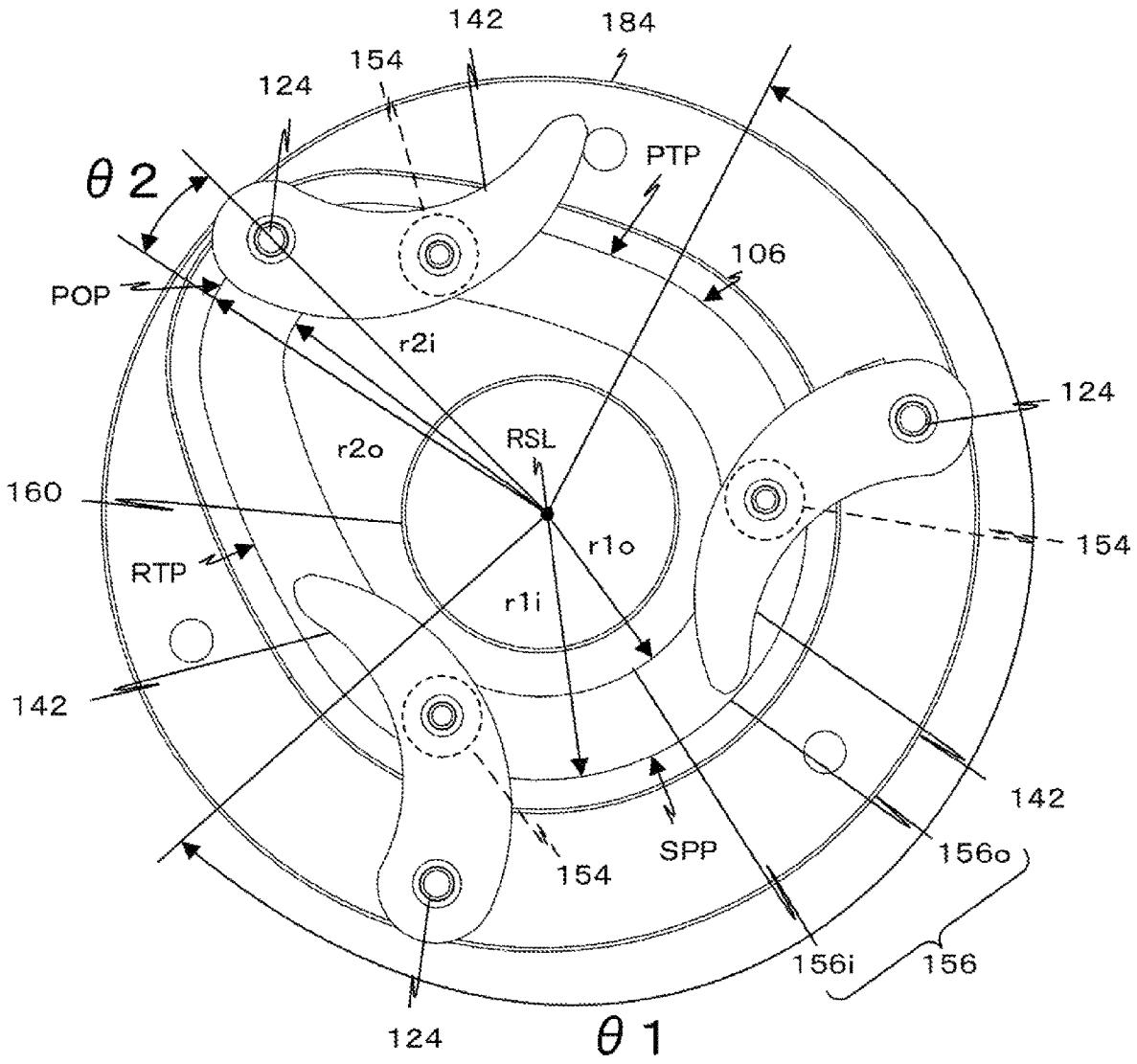
FIG. 7 is a view explaining the working of the coin separating and feeding device of FIG. 1.

Next, the drive means 106 will be described mainly with reference to FIG. 7.

The drive means 106 has a function to move the moving body 142 to the coin receiving position RP or the coin delivering position DP at a predetermined timing. According to the present first embodiment, the drive means 106 is a groove cam 156 which is formed in an eccentric position in a static state relative to the rotary disk 108. The groove cam 156 is formed on an upper surface of the disk-shaped cam constituting body 158 and the cam constituting body 158 is in a disk-shape formed with a circular through hole 160 about an axis overlapping the rotational shaft RSL and is formed with a groove cam 156 in an egg shape on the upper surface side surrounding the through hole 160. The cam constituting body 158 is provided in a fixed state separate from the separating and rotating body 102. In other words, the drive means 106 and the separating and rotating body 102 are coaxial with respect to the rotational shaft RSL and are relatively rotated. By this relative rotation, the cam follower 154 is moved within the groove cam 156 and is moved relative to the groove cam 156 while being guided by an inner cam wall 156*i* and an outer cam wall 156*o* configuring the groove cam 156. The groove cam 156 is configured by a retaining position portion SPP which is formed at a predetermined angle θ1 by a predetermined first inner radius r1*i* and a first outer radius r1*o* about the rotational axis RSL, a push-out position portion POP which is formed at a predetermined angle θ2 by a second inner radius r2*i* which is larger than the first radius r1 and a second outer radius r2*o*, a pushing transition portion PTP and a return transition portion RTP connecting the above. Note that the drive means 106 may be a peripheral surface cam used in general. However, a groove cam is preferable because a spring, etc., can be necessary in the case of the peripheral surface cam—to press onto the peripheral surface cam—and the configuration becomes complicated.

Next, the cover body 162 will be examined.

The cover body 162 covers the upper surface side of the through hole 128 and has a function to reduce minute contamination falling from the through hole 128 downward. According to the present first embodiment, the cover body 162 is formed with the same thickness as the slide plate 116 in a circular shape and is installed in the moving body unit 104. It is preferable to use the cover body 162 of a disk which is cut out when the slide plate 116 is formed with the cover body accommodation hole 132 by a laser processing machine. The cover body 162 is disposed in a state coaxial with the axis of the support shaft 124 and a moving body 142 is disposed in close contact with the upper surface of the cover body 162. According to the present first embodiment, the cover body 162 is integrated into the moving body unit 104. In more detail, the cover body 162 and the moving body 142 are integrated by that the end of the support shaft 124 penetrates through the cover body center hole 162*c* which is formed in the central portion of the cover body 162, the end penetrates through the mounting hole 142*h* of the moving body 142, and, thereafter, the end of the support shaft 124 is caulked, and, furthermore, the end of the coupling body 146 penetrates through the cover body peripheral edge notch 162*n* of the cover body 162, the end penetrates through the coupling body hole 142*c* of the moving body 142, and, thereafter, the end of the coupling body 146 is caulked. The outer peripheral edge of the cover body 162 is disposed rotatably in a state close to the inner edge of the cover body accommodation hole 132. In other words, the cover body accommodation hole 132 and the cover body 162 are disposed in a concentric state and configured not to interfere with the inner peripheral edge of the cover body accommodation hole 132 even if the cover body 162 rotates about the support shaft 124.

Figure 2A:
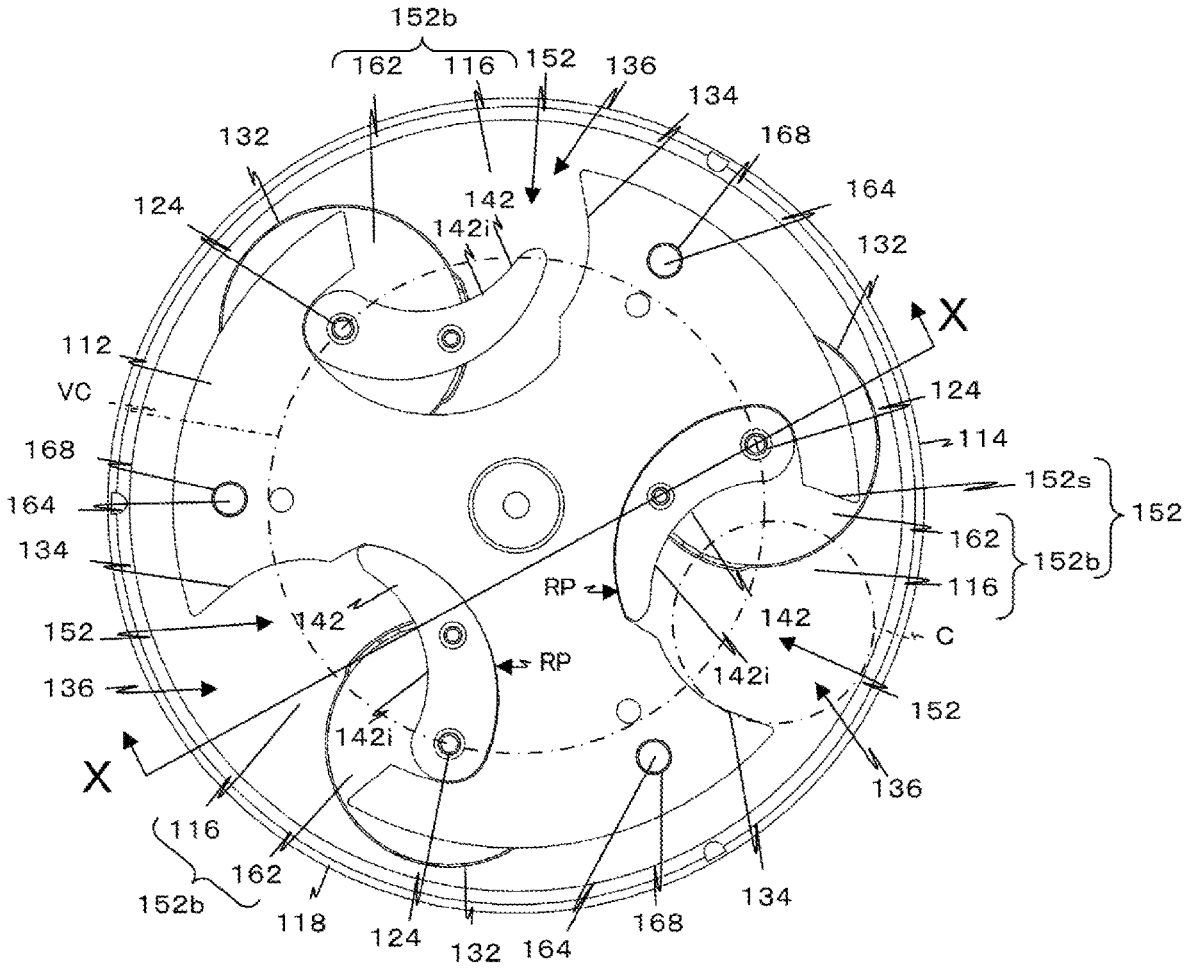
FIG. 2A is a plan view of the coin separating and feeding device of FIG. 1.
Figure 2B:
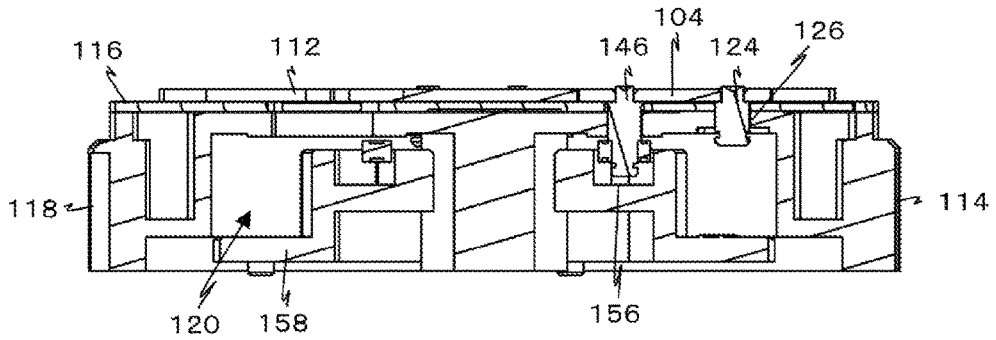
FIG. 2B is a sectional view of the coin separating and feeding device of FIG. 1 taken along the line X-X in FIG. 2A.

As illustrated in FIG. 2A, the separating concave portion bottom surface 152*b* of the separating concave portion 152 is configured by the slide plate 116 and the upper surface of the cover body 162. As stated above, the cover body 162 is tightly and rotatably fitted into the cover body accommodation hole 132 formed at the slide plate 116. In other words, there is essentially no gap between the outer edge of the cover body 162 and the inner edge of the cover body accommodation hole 132 so that minute contamination falling under the rotating disk body 114 is greatly reduced. Accordingly, it is preferable to eliminate collected minute contamination from the upper surface side of the separating and rotating body 102 by making the lower end of the retaining container which retains the coins C in front of the coin separating and feeding device 100 movable such that a gap is formed between the lower end of the retaining container and the upper surface of the separating and rotating body 102 and by forming a gap at a suitable timing.

Next, the method of manufacturing the coin separating and feeding device 100 will be described.

When the coin separating and feeding device 100 is manufactured, first, a rotary disk 108 is configured by coaxially mounting the slide plate 116 on the upper surface of the rotating disk body 114. According to the present first embodiment, for convenient positioning, a predetermined number, preferably two or more, three according to the present embodiment, of positioning protrusions 164 are provided on the upper surface of the rotating disk body 114. A separating plate positioning hole 166 is formed in corresponding positions of the slide plate 116. Thus, by mounting the slide plate 116 such that the positioning protrusion 164 of the rotating disk body 114 fits into the separating plate positioning hole 166, the rotating disk body 114 and the slide plate 116 are automatically mounted concentrically. Note that the slide plate 116 is firmly fixed to the rotating disk body 114 by a fixing means (not shown).

Next, the moving body unit 104 is mounted to the rotary disk 108. Namely, the rotating disk body 114 penetrates through by that, in such a state that the cam follower 154 is not mounted, the support shaft 124 is inserted from the cover body accommodation hole 132 into the support shaft through hole 126, and, also, the coupling body 146 is inserted from the cover body accommodation hole 132 into the through hole 128 from the side of the slide plate 116. Thereby, the cover body 162 is tightly accommodated in the cover body accommodation hole 132 and the upper surface of the slide plate 116 and the upper surface of the cover body 162 become flush. Thereafter, a snap ring is mounted on the peripheral surface at the lower end of the support shaft 124 and the moving body unit 104 is mounted on the rotary disk 108. Furthermore, the cam follower 154 is mounted at the lower end of the coupling body 146 by means of a snap ring, etc., so as not to be detached. Thereby, the cam follower 154 is mounted in such a state that the cam follower 154 protrudes into the accommodation space at the lower surface side of the rotary disk 108. Since the position of the cam follower 154 lies within the thickness of the rotating disk body 114, the cam follower 154 is not visible unless being viewed from the backside.

Next, the separating plate 112 is set up in a predetermined position in contact with the upper surface of the slide plate 116. For an easy set-up, it is preferable to provide the separating plate positioning hole 168 at the separating plate 112. Thereby, the separating plate 112 can be set up in an appropriate positional relationship with respect to the slide plate 116 by fitting the positioning protrusion 164 into the separating plate positioning hole 168. In other words, such an assembly is possible that the moving body 142 is positioned in the concave portion 134. Thereby, the separating and rotating body 102 is assembled. Note that the separating plate 112 is firmly fixed by a fixing means (not shown).

Next, the separating and rotating body 102 is moved from the upper of the cam constituting body 158 which is fixed in a predetermined position and the cam follower 154 is inserted into the groove cam 156, whereby the coin separating and feeding device 100 is configured.

Next, the operation of the coin separating and feeding device 100 will be described with reference to FIG. 7.

The separating and rotating body 102 is rotated via the driven gear 118. In accordance with the rotation of the separating and rotating body 102, the moving body unit 104 is rotated in the counterclockwise direction about the rotational axis RSL in FIG. 7. Accordingly, the cam follower 154 is moved relative to the groove cam 156. Thus, the cam follower 154 occupies a position guided by the groove cam 156. In case the cam follower 154 is guided by the retaining position portion SPP, the moving body 142 is positioned in the coin receiving position RP. In case the cam follower 154 is guided by the pushing transition portion PTP, the moving body 142 is rotated in the counterclockwise direction about the support shaft 124. In case the cam follower 154 is guided by the push-out position portion POP, the moving body 142 is positioned in the coin delivering position DP which is the position of the most advanced counterclockwise rotation. In case the cam follower 154 is guided by the return transition portion RTP, the moving body 142 is rotated clockwise about the support shaft 124 and moved toward the coin receiving position RP, and thereafter, guided by the retaining position portion SPP and returned back to the coin receiving position RP.

Next, the working of the coin separating and feeding device 100 will be described mainly with reference to FIG. 7.

The coins C are supplied to the upper surface of the coin separating and feeding device 100 which is disposed diagonally upward. The coins C fall into the separating concave portion 152 in a state in which the moving body 142 is positioned in the coin receiving position RP in the step in which the coins C are stirred by the rotation of the coin separating and feeding device 100 and are directed into various postures, come into surface contact with the separating concave portion bottom surface 152*b* and are rotated about the rotational axis RSL together with the separating and rotating body 102 by being pushed by the separating concave portion side surface 152*s*. This state is a separation state of the coins C. If the cam follower 154 is guided by the pushing transition portion PTP by further rotation of the separating and rotating body 102, the cam follower 154 is moved in the direction away from the rotational axis RSL. Thus, the moving body 142 is pivoted about the support shaft 124 and rotated in the counterclockwise direction in FIG. 5. Then, the moving body 142 is rotated in the most advanced counterclockwise direction in the position in which the moving body 142 is guided by the push-out position portion POP of the groove cam 156 and moved up to the coin delivering position DP. Thereafter, the moving body 142 is rotated about the support shaft 124 in the clockwise direction in the step in which the moving body 142 is guided to the return transition portion RTP and returned to the coin receiving position RP in the position in which the moving body 142 is guided at the retaining position portion SPP. The coins C held in the separating concave portion 152 are pushed out of the separating concave portion 152 in the peripheral edge direction of the separating and rotating body 102 and delivered to the next process by the movement of the moving body 142 from the coin receiving position RP to the movement position MP.

SECOND EMBODIMENT

Figure 8:
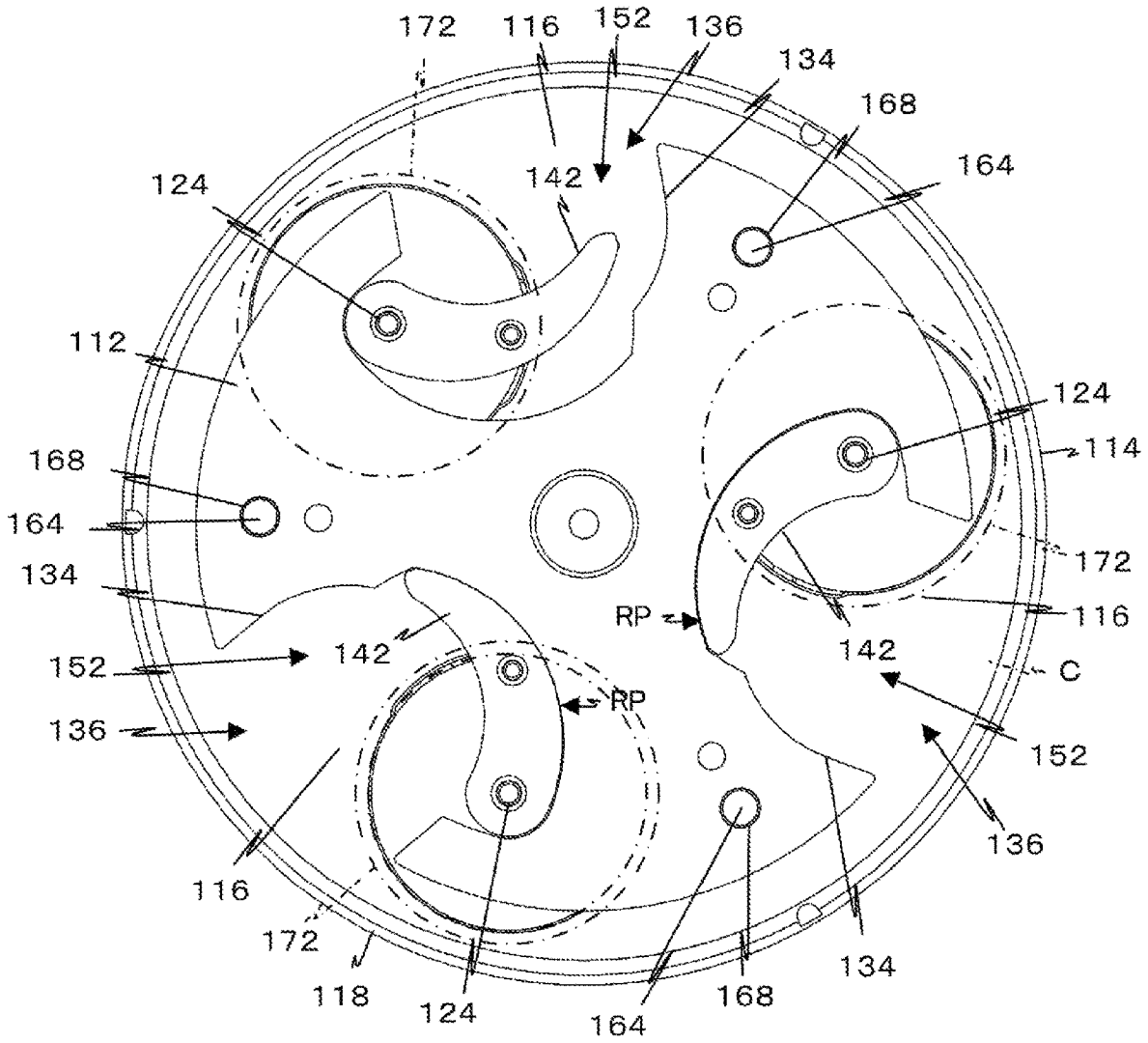
FIG. 8 is a plan view of the coin separating and feeding device in the coin processing device according to a second embodiment of the present invention.

Next, the second embodiment of the present invention will be described with reference to FIG. 8.

The second embodiment has, in general, the same configuration as the first embodiment. However, as shown by the chain line 172, the diameter of the cover body 162 is larger than that of the first embodiment such that the through hole 128 is completely covered. Naturally, the cover body accommodation hole 132 is provided with a large diameter such that the cover body 162 fits tightly. According to the second embodiment, since the upper surface side of the through hole 128 is completely covered with the cover body 162, minute contamination does not fall downward.

What is claimed is:

1. A coin separating and feeding device suitable for use in a coin processing device, the coin separating and feeding device comprising:

a separating and rotating body defining a concave portion defined in an upper surface of the separating and rotating body and extending from each of an upper surface side and a peripheral surface side of the separating and rotating body; and a separating concave portion disposed at a part of the concave portion and formed in a semi-circular shape by a moving body positioned in a coin receiving position;

the moving body, the moving body mounted at a rotary disk of the coin separating and feeding device, the moving body configured to pivot about a support shaft configured as a fulcrum, the moving body pivoted by a drive means positioned under the rotary disk via a coupling body penetrating through a through hole defined in the rotary disk, and the moving body configured to be moved to each of the coin receiving position and a coin delivering position at a predetermined timing by the drive means;

wherein a cover body is disposed at an upper surface side of the through hole, is integrated with the moving body, and defines a disk shape defining a predetermined radius centered on the support shaft.

2. The coin separating and feeding device of claim 1, wherein the separating and rotating body comprises a separating plate, the separating plate defining the concave portion and the separating concave portion.

3. The coin separating and feeding device of claim 1, wherein the cover body at least partially covers the through hole.

4. The coin separating and feeding device of claim 1, wherein:

the cover body is integrated with the moving body.

5. The coin separating and feeding device of claim 1, wherein:

the drive means is a groove cam positioned under the rotary disk, the moving body coupled to a driven body, the driven body positioned in the groove cam via the coupling body;

the through hole is formed in an arc shape centered on the support shaft; and the moving body is configured to be moved to each of the coin receiving position and to the coin delivering position by the groove cam via the driven body and the coupling body at a predetermined timing.

6. The coin separating and feeding device of claim 5, wherein the separating and rotating body comprises a separating plate, the separating plate defining the concave portion and the separating concave portion.

7. The coin separating and feeding device of claim 5, wherein the cover body at least partially covers the through hole.

8. The coin separating and feeding device of claim 1, wherein the cover body covers the most or entire part of the through hole.

9. The coin separating and feeding device of claim 1, wherein the cover body covers at least 86% of a width of the through hole in a radial direction.

10. The coin separating and feeding device of claim 1, wherein the cover body covers at least 87.5% of a width of the through hole in a radial direction.

11. The coin separating and feeding device of claim 1, wherein the cover body covers between 86% and 88% of a width of the through hole in a radial direction.

12. The coin separating and feeding device of claim 1, wherein the cover body covers the entire part of the through hole.

13. The coin separating and feeding device of claim 1, wherein the disk shape is circular.

14. The coin separating and feeding device of claim 1, wherein a percentage of width of the through hole that is covered by the cover body remains constant during movement of the cover body.

15. The coin separating and feeding device of claim 1, wherein the coin separating and feeding device comprises a plurality of cover bodies, each cover body of the plurality of cover bodies having a disk shape.

16. The coin separating and feeding device of claim 15, wherein the separating and feeding device comprises three cover bodies.

17. The coin separating and feeding device of claim 1, wherein the drive means is a groove cam positioned under the rotary disk, the moving body coupled to a driven body, the driven body positioned in the groove cam via the coupling body.

18. The coin separating and feeding device of claim 1, wherein the through hole is formed in an arc shape centered on the support shaft.

* * * * *